US012326279B2

(12) United States Patent
Jacobi

(10) Patent No.: US 12,326,279 B2
(45) Date of Patent: Jun. 10, 2025

(54) WATER TO AIR SWITCHING FLOW HEATER CHILLER

(71) Applicant: Robert W. Jacobi, Indianapolis, IN (US)

(72) Inventor: Robert W. Jacobi, Indianapolis, IN (US)

( * ) Notice: Subject to any disclaimer, the term of this patent is extended or adjusted under 35 U.S.C. 154(b) by 0 days.

(21) Appl. No.: 18/489,309

(22) Filed: Oct. 18, 2023

(65) Prior Publication Data

US 2024/0133591 A1 Apr. 25, 2024
US 2024/0230166 A9 Jul. 11, 2024

Related U.S. Application Data

(60) Provisional application No. 63/380,146, filed on Oct. 19, 2022.

(51) Int. Cl.
*F25B 1/00* (2006.01)
*F24D 17/02* (2006.01)

(52) U.S. Cl.
CPC ..... *F25B 1/00* (2013.01); *F24D 17/02* (2013.01); *F25B 2339/047* (2013.01); *F25B 2600/2507* (2013.01)

(58) Field of Classification Search
CPC ..... F25B 1/00; F25B 2339/047; F25B 2600/2507; F24D 17/02
See application file for complete search history.

(56) References Cited

U.S. PATENT DOCUMENTS 3,760,868 A 9/1973 Cywin
4,375,831 A 3/1983 Downing, Jr.
4,466,256 A 8/1984 MacCracken
4,569,207 A 2/1986 James
6,412,550 B1 7/2002 McLaughlin
6,688,129 B2 2/2004 Ace
(Continued)

FOREIGN PATENT DOCUMENTS

JP 2002-310524 A 10/2002
WO WO 2014/130545 A1 8/2014
WO WO 2015/066764 5/2015

OTHER PUBLICATIONS

International Search Report and Written Opinion issued in PCT/US2021/032052, dated Aug. 23, 2021, 13 pgs.

*Primary Examiner* — Larry L Furdge
*Assistant Examiner* — Keith Stanley Myers
(74) *Attorney, Agent, or Firm* — Woodard, Emhardt, Henry, Reeves & Wagner, LLP

(57) ABSTRACT

A liquid to air switching flow system includes a switching flow apparatus within a housing and a source loop and a production loop that are in fluid communication with the switching flow apparatus. The production loop includes a heating/cooling coil that includes a coil input that receives fluid the switching flow apparatus and a coil output that returns fluid to the switching flow apparatus. In a heating mode a first heat exchanger, acting as a condenser, is fluidly connected to the production loop to provide heated liquid to the heating/cooling coil. In a cooling mode, a second heat exchanger, acting as an evaporator, is fluidly connected to the production loop to provide cooled liquid to the heating/cooling coil. A fan is positioned within the housing to push air across the heating/cooling coil to heat the air in the heating mode or cool the air in the cooling mode.

19 Claims, 6 Drawing Sheets

(56) References Cited

U.S. PATENT DOCUMENTS

| | | | | |
|---|---|---|---|---|
| 8,701,432 | B1 | 4/2014 | Olson | |
| 8,815,093 | B2 | 8/2014 | Mahony | |
| 9,038,408 | B2 | 5/2015 | Sabo | |
| 10,443,909 | B2 | 10/2019 | Wiggs | |
| 11,493,227 | B2 | 11/2022 | Jacobi | |
| 2006/0242983 | A1 | 11/2006 | Spadafora et al. | |
| 2007/0209380 | A1 | 9/2007 | Mueller et al. | |
| 2008/0022713 | A1 | 1/2008 | Jacobi | |
| 2010/0139886 | A1 | 6/2010 | Desmeules | |
| 2010/0236750 | A1 | 9/2010 | Naneff et al. | |
| 2010/0236772 | A1 | 9/2010 | Novotny et al. | |
| 2012/0255706 | A1 | 10/2012 | Tadayon et al. | |
| 2012/0261091 | A1 | 10/2012 | Krecke | |
| 2013/0037236 | A1 | 2/2013 | Saunier et al. | |
| 2013/0228309 | A1 | 9/2013 | Wood | |
| 2014/0033743 | A1* | 2/2014 | Hancock | F25B 27/02 62/238.1 |
| 2014/0048244 | A1 | 2/2014 | Wallace | |
| 2014/0284275 | A1 | 9/2014 | Boccato et al. | |
| 2015/0013370 | A1 | 1/2015 | Wiggs | |
| 2015/0033779 | A1 | 2/2015 | Seggerman | |
| 2016/0123638 | A1 | 5/2016 | Kimura et al. | |
| 2016/0305694 | A1 | 10/2016 | Leibundgut | |
| 2017/0198950 | A1 | 7/2017 | Bresson et al. | |
| 2017/0328588 | A1 | 11/2017 | Medlock et al. | |
| 2018/0142935 | A1 | 5/2018 | Jacobi | |
| 2018/0283799 | A1 | 10/2018 | Sakai et al. | |
| 2018/0356106 | A1* | 12/2018 | Christopher | F24F 11/89 |
| 2018/0363969 | A1 | 12/2018 | Jacobi | |
| 2020/0378633 | A1 | 12/2020 | Hall et al. | |
| 2021/0404696 | A1* | 12/2021 | Jacobi | C02F 3/006 |

* cited by examiner

WATER TO AIR SWITCHING FLOW HEATER CHILLER

BACKGROUND

Heating/cooling systems may be used to provide temperature control to a desired structure or other desired area, for example in an HVAC loop. The heating/cooling system also includes a source loop, mechanical or geothermal, for heat rejection or heat absorption. Some common heating/cooling system use a water source heat pump that employs a reversing flow refrigeration loop to switch from heating to cooling. These water source heat pumps include a heat exchanger that is always connected to the source loop and include another heat exchanger that is always connected to the HVAC loop. When switching between heating and cooling the flow of the refrigerant in the refrigeration loop is reversed and the role of the heat exchangers is switched from acting as a condenser to acting as an evaporator or vice versa. Efficiency is lost when converting the heat exchangers between operational modes. Therefore, there is a need for improvement in this field.

SUMMARY

A water to air switching flow system may include a system housing and a switching flow apparatus within the system housing. The switching flow apparatus may include an apparatus housing, and a refrigerant loop positioned within the apparatus housing. The refrigerant loop may include a compressor, a first heat exchanger, an expansion valve, and a second heat exchanger. A first heat exchanger inlet may allow fluid to enter the first heat exchanger and a first heat exchanger outlet allows fluid to exit the first heat exchanger. A second heat exchanger inlet may allow fluid to enter the second heat exchanger and a second heat exchanger outlet allows fluid to exit the second heat exchanger. A control panel may be used to control the line voltage for the compressor of the refrigerant loop.

A source return inlet may be in fluid communication with a source return line exterior to the apparatus housing, and a source supply outlet may be in fluid communication with a source supply line exterior to the apparatus housing. A production return inlet may be in fluid communication with a production return line exterior to the apparatus housing, and a production supply outlet may be in fluid communication with a production supply line exterior to the apparatus housing.

In a cooling mode, the source return inlet may be in fluid communication with the first heat exchanger inlet and the source supply outlet may be in fluid communication with the first heat exchanger outlet. The production return inlet may be in fluid communication with the second heat exchanger inlet and the production supply outlet may be in fluid communication with the second heat exchanger outlet.

In a heating mode, the production return inlet may be in fluid communication with the first heat exchanger inlet and the production supply outlet may be in fluid communication with the first heat exchanger outlet. The source return inlet may be in fluid communication with the second heat exchanger inlet and the source supply outlet may be in fluid communication with the second heat exchanger outlet.

The water to air switching flow system may include a source loop and a production loop. The source loop can include the source return line which extends through a source inlet opening defined through the system housing.

The source loop may also include the source supply line fluid which extends through a source outlet opening defined through the system housing.

The production loop can include a production return line in fluid communication with said production return inlet and may include a production supply line in fluid communication with said production supply outlet. The production return line and the production supply line may be exterior of the apparatus housing but still contained within the system housing. The production supply line may be in fluid communication with a heating/cooling coil positioned within the system housing through a coil inlet. The production return line may be in fluid communication with the heating/cooling coil within the system housing through a coil outlet.

Production fluid from the switching flow apparatus may flow through the production supply line and into the heating/cooling coil through the coil inlet. The production fluid then flows through the heating/cooling coil to provide heat exchange with air that may be pushed across the heating/cooling coil by a fan positioned within the system housing. After running through the heating/cooling coil, the production fluid can exit through the coil outlet and into the production return line to be returned to the switching flow apparatus.

The coil inlet and the coil outlet may be in fluid communication with the first heat exchanger when the switching flow system may be in heating mode. In some embodiments, the first heat exchanger may be a condenser. When the switching flow system may be in cooling mode, the coil inlet and the coil outlet may be in fluid communication with the second heat exchanger. In some embodiments, the second heat exchanger may be an evaporator.

Air may enter the switching flow system through a return air inlet that allows return air from the external environment to enter the housing. In some instances, the air from the external environment may be provided to the air inlet by a duct that may be part of a ductwork system. In some embodiments, an air filter may be positioned within the return air inlet to filter the return air provided to the switching flow system. The air may be blown by a fan across the heating/cooling coil to cool the air when the switching flow system may be in the cooling mode and to heat the air when the switching flow system may be in the heating mode. The air may then be pushed out of the system housing through a supply air outlet defined through the system housing and into an exterior space to be either heated or cooled.

In some examples, the switching flow system may include free cooling or free heating that allows the switching flow apparatus to be bypassed. A direct free return line fluidly connects the production return line to the source supply line. A free return diverting valve may direct source fluid directly to the source supply line from the production return line without requiring the source fluid to enter the switching flow apparatus. Likewise, a direct free supply line may fluidly connect the source return line to the production supply line. A free supply diverting valve may direct source fluid directly from the source return line to the production supply line without requiring the liquid to enter the switching flow apparatus.

In some instances, a first heat exchanger bypass line may be in fluid communication with the source return inlet and with the second heat exchanger inlet. Additionally, a second heat exchanger bypass line may be in fluid communication with the coil outlet and the first heat exchanger inlet.

In some examples, the switching flow apparatus may include a first heat exchanger control valve in fluid communication with a first heat exchanger outlet. The first heat exchanger control valve may be configured to direct fluid from the first heat exchanger outlet to the source supply line in the cooling mode. The first heat exchanger control valve may be configured to direct fluid from the first heat exchanger outlet to the coil inlet through the production supply line in the heating mode.

The switching flow apparatus may also include a first heat exchanger on/off valve in fluid communication with a first heat exchanger inlet. The first heat exchanger on/off valve may be configured to be closed in the cooling mode so that the first heat exchanger inlet is in fluid communication with the source return line. The first heat exchanger on/off valve may be configured to be open in the heating mode so that the first heat exchanger inlet is in fluid communication with the coil outlet through the production return line.

In some examples, the switching flow apparatus may include a second heat exchanger control valve in fluid communication with the second heat exchanger outlet. The second heat exchanger control valve may be configured to direct fluid from the second heat exchanger outlet to the coil inlet through the production supply line in the cooling mode. The second heat exchanger control valve is configured to direct fluid from the second heat exchanger outlet to the source supply line in the heating mode.

The switching flow apparatus may also include a second heat exchanger on/off valve in fluid communication with a second heat exchanger inlet. The second heat exchanger on/off valve may be configured to be closed in the cooling mode so that the second heat exchanger inlet is in fluid communication with the coil outlet through the production return line. The second heat exchanger on/off valve may be configured to be open in the heating mode so that the second heat exchanger inlet is in fluid communication with the source return line.

In some embodiments, the switching flow apparatus may include a domestic hot water supply line in fluid communication with a first heat exchanger outlet of said first heat exchanger. The domestic hot water supply line may be configured to divert fluid from said first heat exchanger outlet to a hot water tank.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
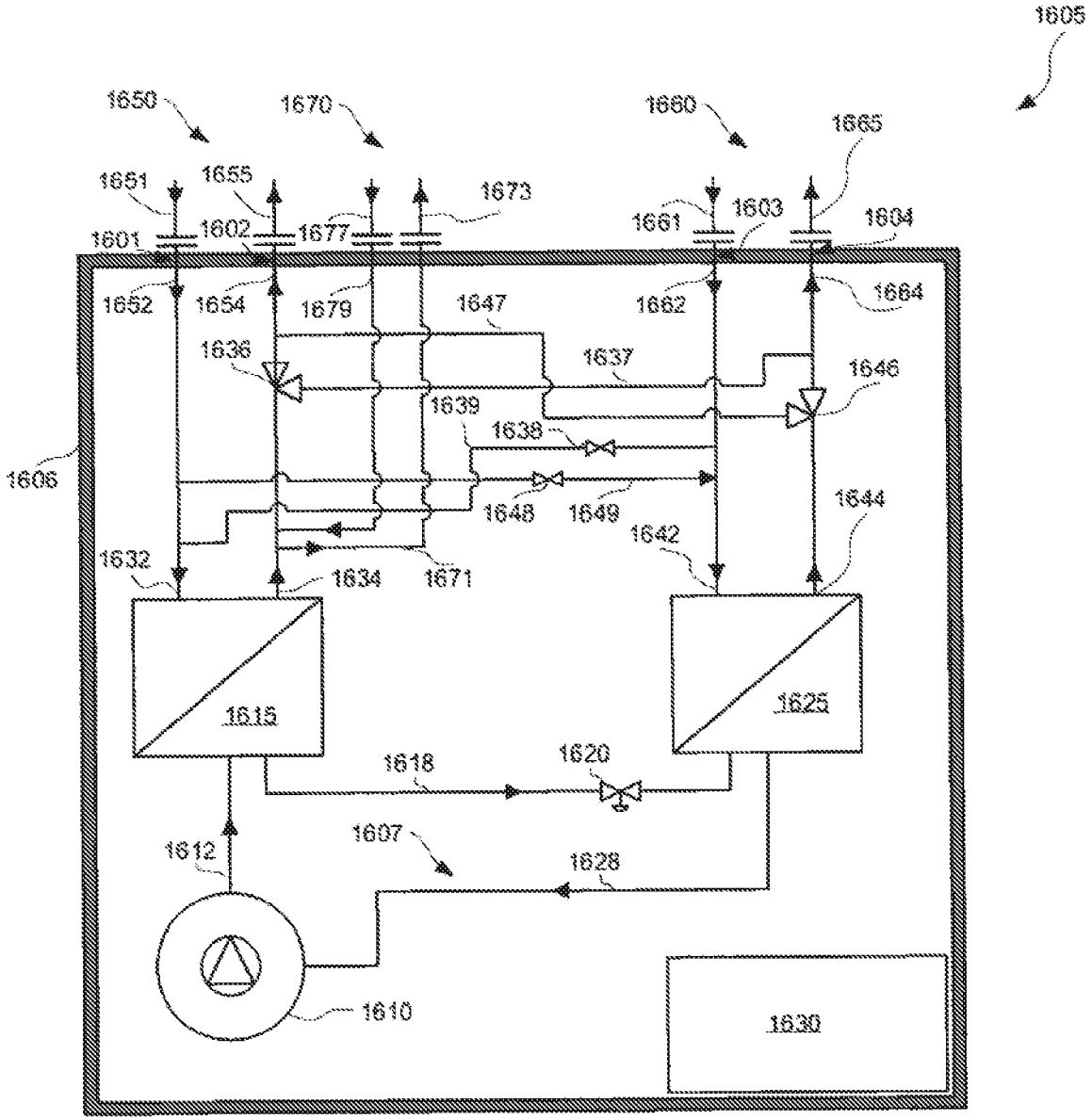
FIG. 1 is a partial schematic view of a switching flow apparatus of a switching flow source system.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 illustrates a switching flow apparatus 1605 of a switching flow source system 1600 (see FIG. 2) also described as a switching flow water source heater chiller. The switching flow source system 1600 is within a housing 1606 and, as described below, is connectable to various different fluid loops, such as a source loop and/or a production loop. The housing 1606 is designed to enclose the various components of the switching flow source system 1600 in a manner so that the housing 1606 and the included components have some degree of portability.

The switching flow source system 1600 provides an efficient water heating/cooling, compressor-based refrigeration cycle that is contained within the housing 1606. The refrigeration cycle includes a refrigerant loop 1607 that includes a compressor 1610, a first heat exchanger 1615, represented in this embodiment by a condenser, an expansion valve 1620, and a second heat exchanger 1625, represented in this embodiment by an evaporator. Refrigerant flows from the compressor 1610 to the first heat exchanger 1615 through a hot gas discharge pipe 1612. The first heat exchanger 1615 is in fluid communication with the second heat exchanger 1625 through a liquid pipe 1618. The liquid refrigerant discharged from the first heat exchanger 1615 flows within liquid pipe 1618 and through expansion valve 1620 before entering second heat exchanger 1625. Evaporated refrigerant is discharged from second heat exchanger 1625 into a suction pipe 1628 that extends between second heat exchanger 1625 and compressor 1610. The refrigerant is compressed at compressor 1610 and the cycle is restarted. A control panel 1630 controls the line voltage for the compressor 1610 and also includes low voltage wiring to various sensors present in the switching flow source system 1600.

In addition to the refrigerant loop, the switching flow source system 1600 includes hydronic loops that provide water to exchange heat with the refrigerant running through the first heat exchanger 1615 and the second heat exchanger 1625. One of the hydronic loops is a source loop 1650, and is represented in this embodiment as a geothermal loop (see FIG. 1-2). However, other possible mechanical sources may also be used, such as a solar thermal or boiler source. The other hydronic loop is a production loop 1660, and is represented in this embodiment as an HVAC loop (see FIGS. 1-2). As described below, the paths of the source loop 1650 and the production loop 1660 can be modified by the use of valves within the switching flow source system 1600 depending on whether heating or cooling is desired as the output of the production loop 1660.

Water from one of the hydronic loops enters the first heat exchanger 1615 through a first heat exchanger inlet or a first heat exchanger inlet 1632. The hydronic loop that is connected to the condenser depends on whether the switching flow source system 1600 is operating in heating mode or cooling mode. Heat exchange occurs at the first heat exchanger 1615 between refrigerant from the refrigerant loop and the water that enters through a first heat exchanger inlet 1632. Heated water then exits from first heat exchanger 1615 through a first heat exchanger outlet or a first heat exchanger outlet 1634. Likewise, water from the opposite hydronic loop enters the second heat exchanger 1625 through a second heat exchanger inlet, or a second heat exchanger inlet 1642. Heat exchange occurs at the second heat exchanger 1625 between refrigerant from the refrigerant loop 1607 and the water that enters through second heat exchanger inlet 1642. Cooled water then exits from second heat exchanger 1625 through second heat exchanger outlet 1644.

A first heat exchanger control valve 1636 is in fluid communication with the first heat exchanger outlet 1634. In a first, straight through flow condition, the first heat exchanger control valve 1636 sends the heated water output from the first heat exchanger outlet 1634 to a source supply outlet 1654 that is in fluid communication with a source supply line 1655. The source supply outlet 1654 connects to the source supply line 1655 through a source supply opening 1602 defined through the housing 1606. In a second, bypass condition, the first heat exchanger control valve 1636 sends the heated water output from the first heat exchanger outlet 1634 through a first heat exchanger outlet bypass flow line 1637 to a production supply outlet 1664 that is in fluid communication with a production supply line 1665.

A second heat exchanger control valve 1646 is in fluid communication with the second heat exchanger outlet 1644. In a first, straight through flow condition, the second heat exchanger control valve 1646 sends the cooled water output from the second heat exchanger outlet 1644 to the production supply outlet 1664 that is in fluid communication with the production supply line 1665. The production supply outlet 1664 connects to the production supply line 1665 through a production supply opening 1604 defined through the housing 1606. In a second, bypass condition, the second heat exchanger control valve 1646 sends the cooled water output from the second heat exchanger outlet 1644 through a second heat exchanger outlet bypass flow line 1647 to the source supply outlet 1654 that is in fluid communication with the source supply line 1655.

A first heat exchanger on/off valve 1638 is in fluid communication with the first heat exchanger inlet 1632 and a production return inlet 1662 through a second heat exchanger bypass line 1639. The production return inlet 1662 is in fluid communication with a production return line 1661. The production return inlet 1662 connects to the production return line 1661 through a production return opening 1603 defined through the housing 1606. When the first heat exchanger on/off valve 1638 is in the off condition, fluid from the production return inlet 1662 is sent straight to the second heat exchanger inlet 1642. When the first heat exchanger on/off valve 1638 is in the on condition, fluid from the production return inlet 1662 is sent through the second heat exchanger bypass line 1639 and to the first heat exchanger inlet 1632.

A second heat exchanger on/off valve 1648 is in fluid communication with the second heat exchanger inlet 1642 and source return inlet 1652 through a first heat exchanger bypass line 1649. The source return inlet 1652 is in fluid communication with a source return line 1651. The source return line 1651 connects to the source return inlet 1652 through a source return opening 1601 defined through the housing 1606. When the second heat exchanger on/off valve 1648 is in the off condition, fluid from the source return inlet 1652 is sent straight to the first heat exchanger inlet 1632. When the second heat exchanger on/off valve 1648 is in the on condition, fluid from the source return inlet 1652 is sent through the first heat exchanger bypass line 1649 and to the second heat exchanger inlet 1642.

In some embodiments, the switching flow source system 1600 may also include a domestic hot water loop 1670. The domestic hot water loop 1670 diverts the heated water from the first heat exchanger outlet 1634 before it reaches the first heat exchanger control valve 1636. The heated water is sent through a domestic hot water supply line 1671 that is in fluid communication with a hot water supply inlet 1673. From the hot water supply inlet 1673 the hot water is directed to a hot water tank 1675 (see FIG. 2). The heated water is then returned using a water pump 1676 to send the water through a hot water return outlet 1677 and into a hot water return line 1679. The heated water is then sent to the first heat exchanger control valve 1636.

The switching flow source system 1600 is arranged so that it may be switched between a heating mode and a cooling mode without having to reverse the flow of the refrigerant in the refrigerant loop and without having to the change the operation of the evaporator and the condenser. Therefore, the high pressure portion ("high side") of the refrigeration loop and the low pressure portion ("low side") of the refrigeration loop remains the same regardless of whether the switching flow source system 1600 is operating in heating mode or cooling mode.

Figure 2:
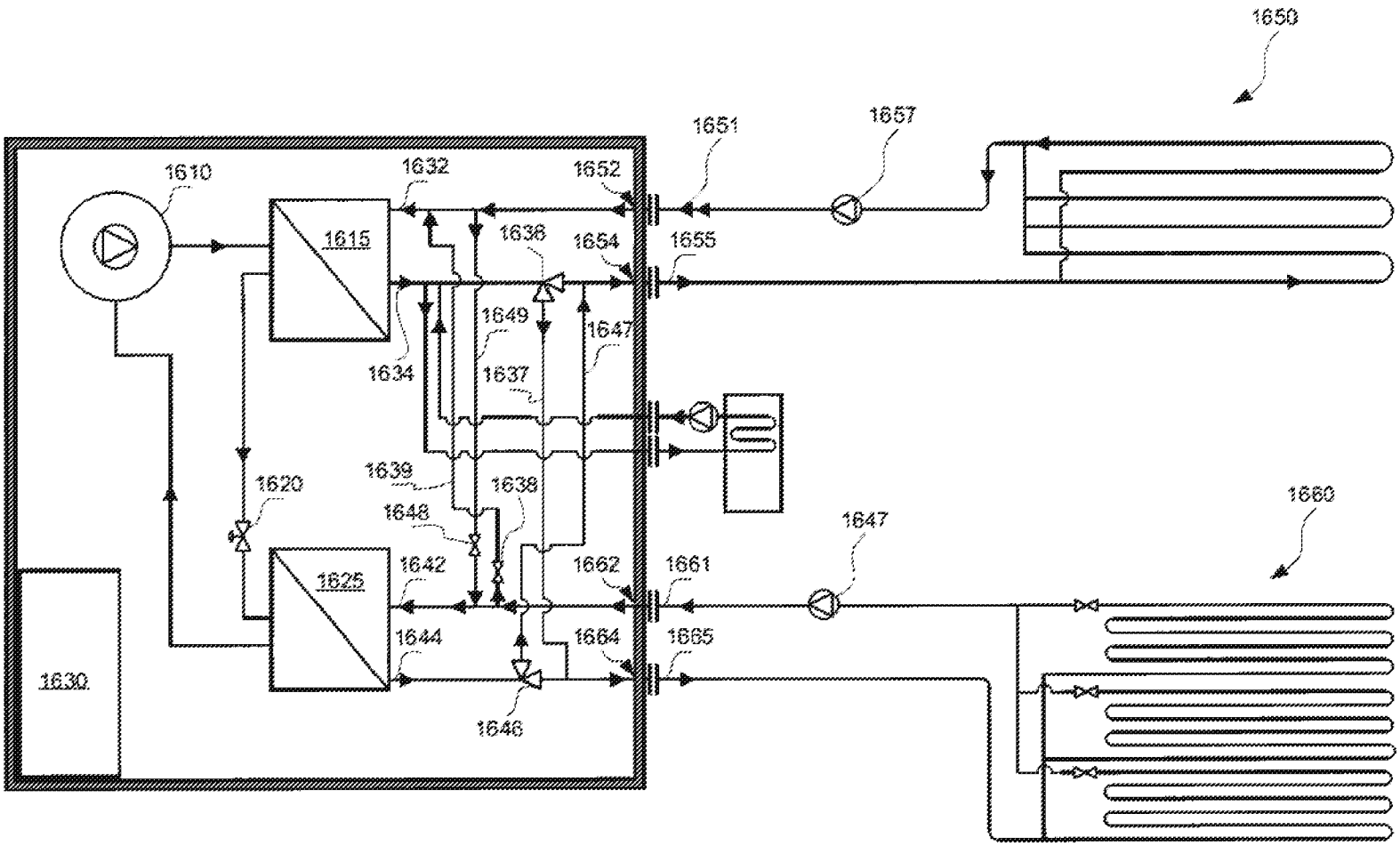
FIG. 2 is a schematic view of the switching flow source system arranged in a cooling mode.

The switching flow source system 1600 in a cooling mode is illustrated in FIG. 2. In the cooling mode, the control valves 1636, 1646 and the on/off valves 1638, 1648 are arranged so that the first heat exchanger 1615 is part of the source loop 1650 and the second heat exchanger 1625 is part of the production loop 1660.

In the cooling mode, the first heat exchanger control valve 1636 is arranged in the straight through flow condition so that heated water exiting the first heat exchanger 1615 through the first heat exchanger outlet 1634 is directed to the source supply outlet 1654 and contained within the source loop 1650. The heated water from the first heat exchanger 1615 travels through the source loop 1650 where it is cooled by the geothermal source. After traveling through the source loop 1650, the cooled water is pumped by a water pump 1657 through the source return inlet 1652 and back to the first heat exchanger 1615 to continue the cycle.

The second heat exchanger control valve 1646 is also arranged in the straight through flow condition so that cooled water exiting the second heat exchanger 1625 through the second heat exchanger outlet 1644 is directed to the production supply outlet 1664 and into the production loop 1660. This cooled water can be used for cooling the structure served by the production loop 1660. Once the cooled water has been used, the water is pumped through a water pump 1667 and returned through the production return inlet 1662 to the second heat exchanger 1625.

In the cooling mode, the first heat exchanger on/off valve 1638 and the second heat exchanger on/off valve 1648 are both maintained in the off condition. This allows water from the source return inlet 1652 to run straight through to the first heat exchanger inlet 1632 and into the first heat exchanger 1615. Water from the production return inlet 1662 runs to the second heat exchanger inlet 1642 and into the second heat exchanger 1625.

Figure 3:
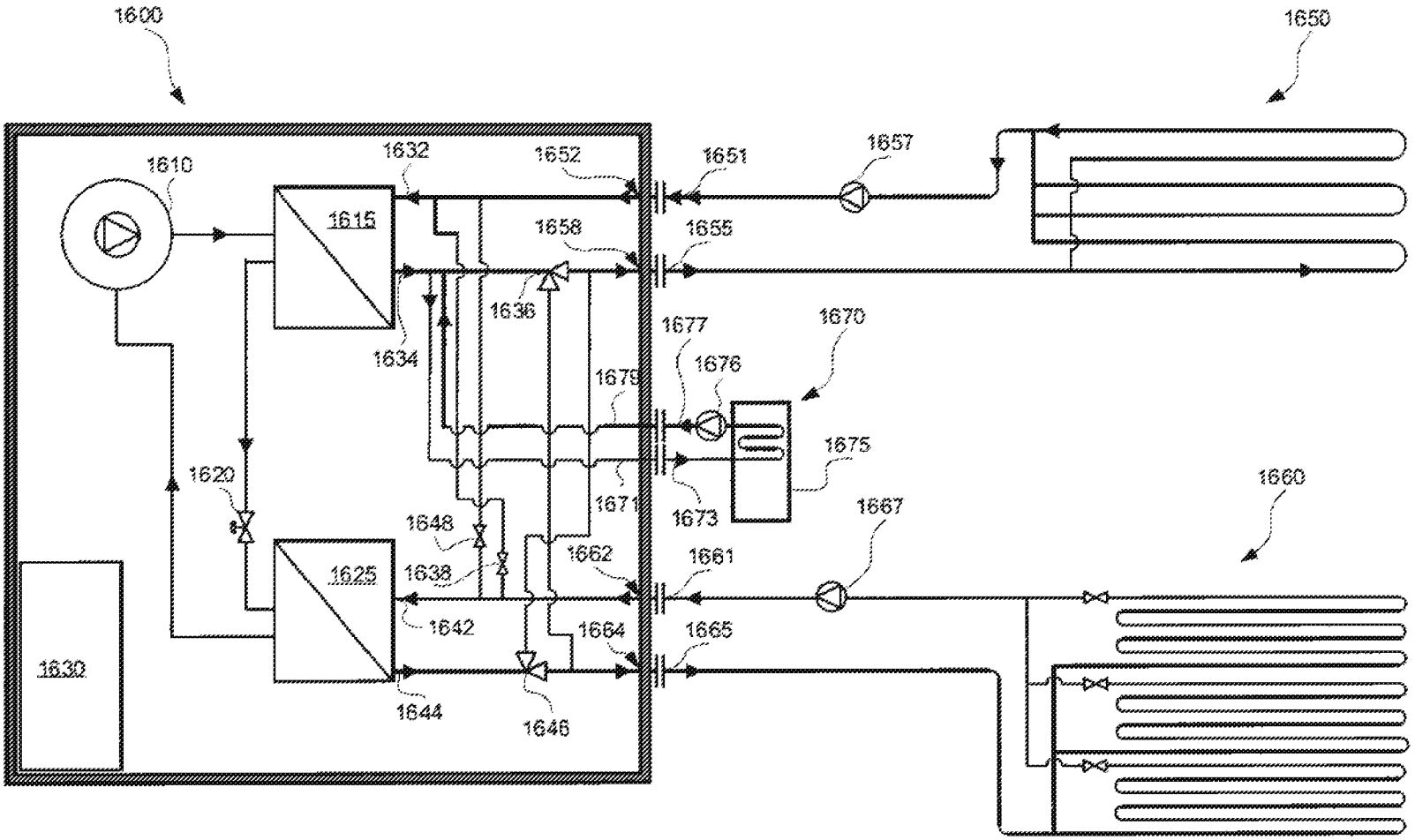
FIG. 3 is a schematic view of the switching flow source system of FIG. 2 arranged in a heating mode.

The switching flow source system 1600 in a heating mode is illustrated in FIG. 3. In the heating mode, the control valves 1636, 1646 and the on/off valves 1638, 1648 are arranged so that the first heat exchanger 1615 is part of the production loop 1660 and the second heat exchanger 1625 is part of the source loop 1650.

In the heating mode, the first heat exchanger control valve 1636 is arranged in the bypass flow condition so that heated water exiting the first heat exchanger 1615 through the first heat exchanger outlet 1634 is directed through the first heat exchanger outlet bypass flow line 1637 and to the production supply outlet 1664 so that the heated water is within the production loop 1660. The heated water from the first heat exchanger 1615 travels through the production loop 1660 where it is used to heat the structure that is served by the production loop 1660.

After traveling through the production loop 1660, the water is pumped by a water pump 1667 through the production return inlet 1662. In the heating mode, the first heat exchanger on/off valve 1638 is maintained in the on condition, so that the return water from the production loop 1660 is sent through the second heat exchanger bypass line 1639 and returned to first heat exchanger 1615 through the first heat exchanger inlet 1632.

The second heat exchanger control valve 1646 is also arranged in the bypass flow condition in the heating mode so that chilled water exiting the second heat exchanger 1625 through the second heat exchanger outlet 1644 is directed through the second heat exchanger outlet bypass flow line 1647 and to the source supply outlet 1654 so that the chilled water is within the source loop 1650. The chilled water from the second heat exchanger 1625 travels through the source loop 1650 where heat from the geothermal source is transferred to the chilled water to raise the temperature of the chilled water.

After traveling through the source loop 1650, the water is pumped by a water pump 1657 through the source return inlet 1652. In the heating mode, the second heat exchanger on/off valve 1648 is maintained in the on condition, so that the return water from the source loop 1650 is sent through the first heat exchanger bypass line 1649 and returned to the second heat exchanger 1625 through the second heat exchanger inlet 1642.

Figure 4:
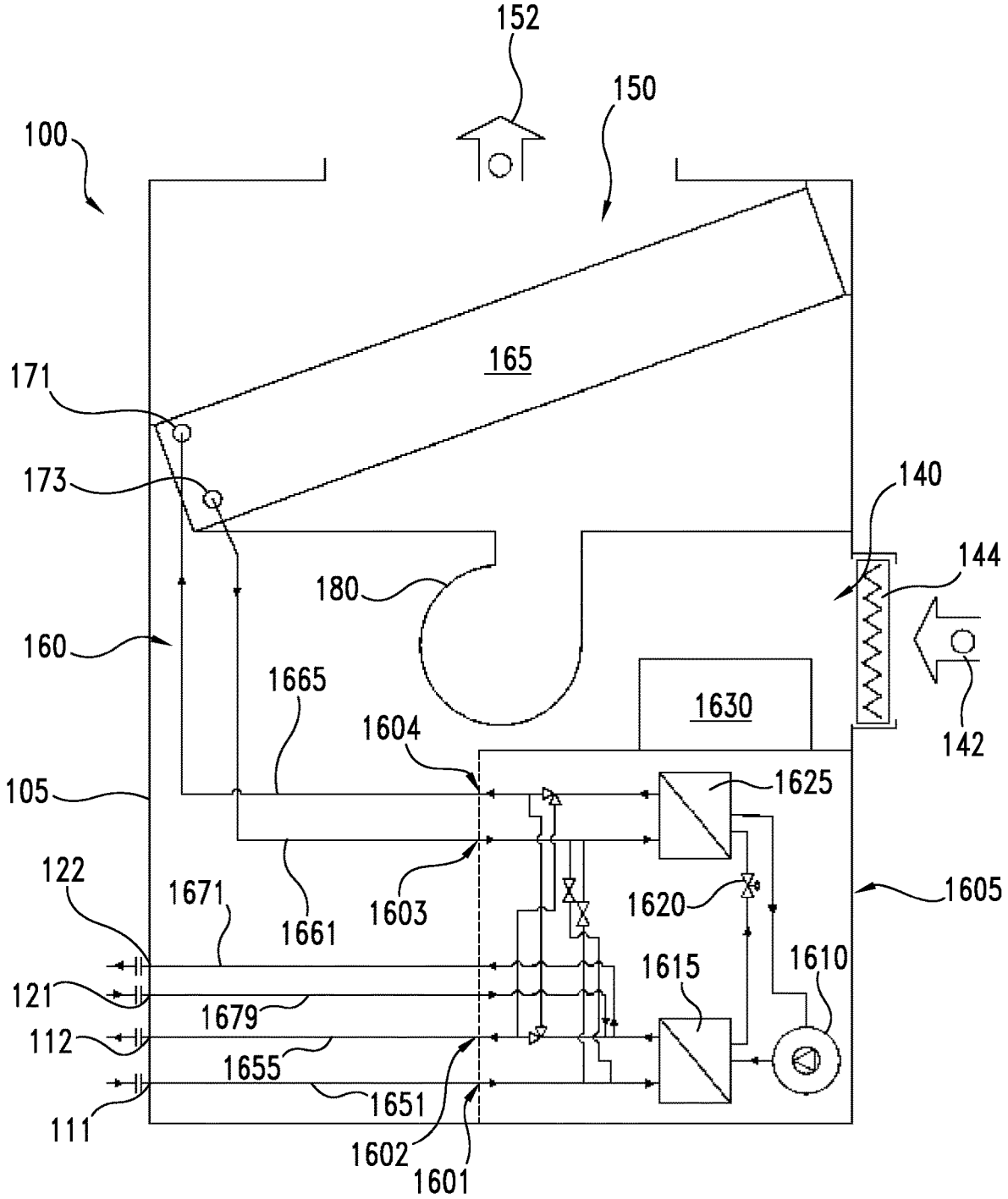
FIG. 4 is a schematic view of a liquid to air switching flow system including the switching flow apparatus of FIG. 1.

FIG. 4 shows an embodiment of a water to air switching flow system 100 that includes the switching flow apparatus 1605 shown and described in FIG. 1. The switching flow system 100 is designed to provide heated or chilled air from a packaged unit. The heated or chilled air may be used in a residential or a commercial setting to provide for temperature modulation. The switching flow system 100 includes a housing 105. The switching flow apparatus 1605 is contained within the housing 105. The housing 105 includes a source inlet opening 111 for receiving the source return line 1651 and a source outlet opening 112 for the source supply line 1655. The housing 105 may also include a hot water inlet opening 121 for receiving the hot water return line 1679 and a hot water outlet opening 122 for the hot water supply line 1671.

The housing 105 includes a return air inlet 140 that allows return air 142 from the external environment to enter the housing 105. An air filter 144 may be positioned within the return air inlet so that the return air 142 passes through the air filter 144 before entering the housing 105. The housing 105 also includes a supply air outlet 150, where heated or cooled supply air 152 may be expelled from the housing 105 and into an exterior space that is desired to be heated or cooled. In some examples, the return air inlet 140 may be connected to ductwork that moves air within a structure to be heated or cooled.

In the switching flow system 100, a production loop 160 includes a production return line 1661, a production supply line 1665, and a two-pipe, heating/cooling coil 165. The production supply line 1665 is in fluid communication with a coil inlet 171 that leads into the heating/cooling coil 165. The production return line 1661 is in fluid communication with a coil outlet 173 that returns fluid that has run through the heating/cooling coil 165 back to the switching flow apparatus 1605.

A fan 180 is positioned within the housing 105, adjacent to the heating/cooling coil 165. The return air 142 is blown by the fan 180 across the heating/cooling coil 165 to either heat or cool the air as desired and to turn the return air 142 into supply air 152. The supply air 152 exits the housing 105 through the supply air outlet 150 and into the exterior space to be heated or cooled. In some embodiments, the supply air outlet 150 may be connected to ductwork that moves the heated or cooled air to a desired location of the exterior space.

The switching flow system 100 can act as either a heater or a chiller depending on whether the switching flow apparatus 1605 is operated in the heating mode or the cooling mode. When the switching flow apparatus 1605 is operated in the heating mode, heated fluid from the first heat exchanger 1615 is directed by the first heat exchanger control valve 1636 through the first heat exchanger outlet bypass flow line 1637 and into the production supply line 1665. The heated fluid travels through the production supply line 1665 into heating/cooling coil 165 through the coil inlet 171. Return air 142 that is blown by the fan 180 across the heating/cooling coil 165 is heated by the heated fluid in the heating/cooling coil 165 and then expelled through the supply air outlet 150 as heated air to heat the exterior space. The heated fluid within the heating/cooling coil 165 then exits the heating/cooling coil 165 through the coil outlet 173 and enters the production return line 1661 to be returned to the first heat exchanger 1615 through the second heat exchanger bypass line 1639 as directed by the first heat exchanger on/off valve 1638.

When the switching flow apparatus 1605 is operated in the cooling mode, chilled fluid from the second heat exchanger 1625 is directed by the second heat exchanger control valve 1646 through the production supply outlet 1664 and into the production supply line 1665. The chilled fluid travels through the production supply line 1665 into heating/cooling coil 165 through the coil inlet 171. Return air 142 that is blown by the fan 180 across the heating/cooling coil 165 is cooled by the chilled fluid in the heating/cooling coil 165 and then expelled through the supply air outlet 150 as chilled air to cool the exterior space. The chilled fluid within the heating/cooling coil 165 then exits the heating/cooling coil 165 through the coil outlet 173 and enters the production return line 1661 to be returned to the second heat exchanger 1625 through the production return inlet 1662 and into the second heat exchanger inlet 1642.

In some embodiments, a single water to air switching flow system 100 may be used to provide the heating and cooling requirements of a space. However, in other embodiments, multiple water to air switching flow systems 100 may be used in tandem to provide the heating and/or cooling requirements for a space. For example, a switching flow system may be included on each floor of a building to provide for the heating and cooling needs of each floor. In other embodiments, a building to be heated or cooled may have multiple zones and a switching flow system may be positioned in each zone.

Figure 5:
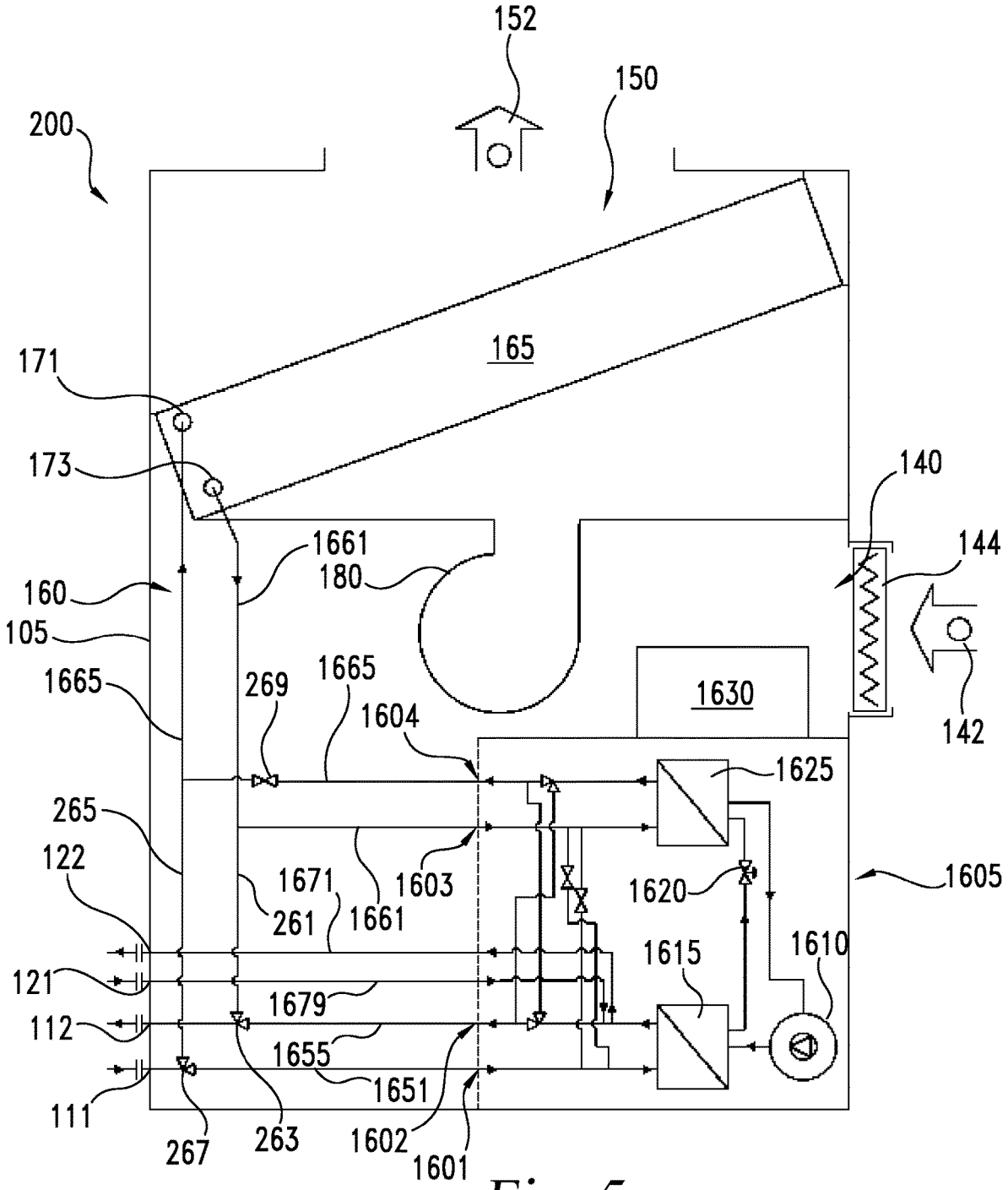
FIG. 5 is a schematic view of a liquid to air switching flow system that includes free heating and free cooling.

An alternative embodiment of a water to air switching flow system 200 is illustrated in FIG. 5. The switching flow system 200 is similar to the switching flow system 100, but includes an option for free cooling and free heating from the source loop. A direct free supply line 265 extends between and is in fluid communication with the production supply line 1665 and a free supply diverting valve 267. In the embodiment shown, the free supply diverting valve 267 is a three-way diverting valve that is positioned on the source return line 1651 so that the source fluid may be either diverted to the direct free supply line 265 or continue on the source return line 1651 to the source return opening 1601 of the switching flow apparatus 1605. A closed valve 269 prevents back flow of the source fluid through production supply line 1665 and into the second heat exchanger 1625 through the second heat exchanger outlet 1644.

A direct free return line 261 extends between and is in fluid communication with the production return line 1661 and a free return diverting valve 263. In the embodiment shown, the free return diverting valve 263 is a three-way diverting valve that is positioned on the source supply line 1655 so that the source fluid may be either diverted to the direct free return line 261 or continue on the source supply line 1655 to the source supply opening 1602 of the switching flow apparatus 1605.

Figure 6:
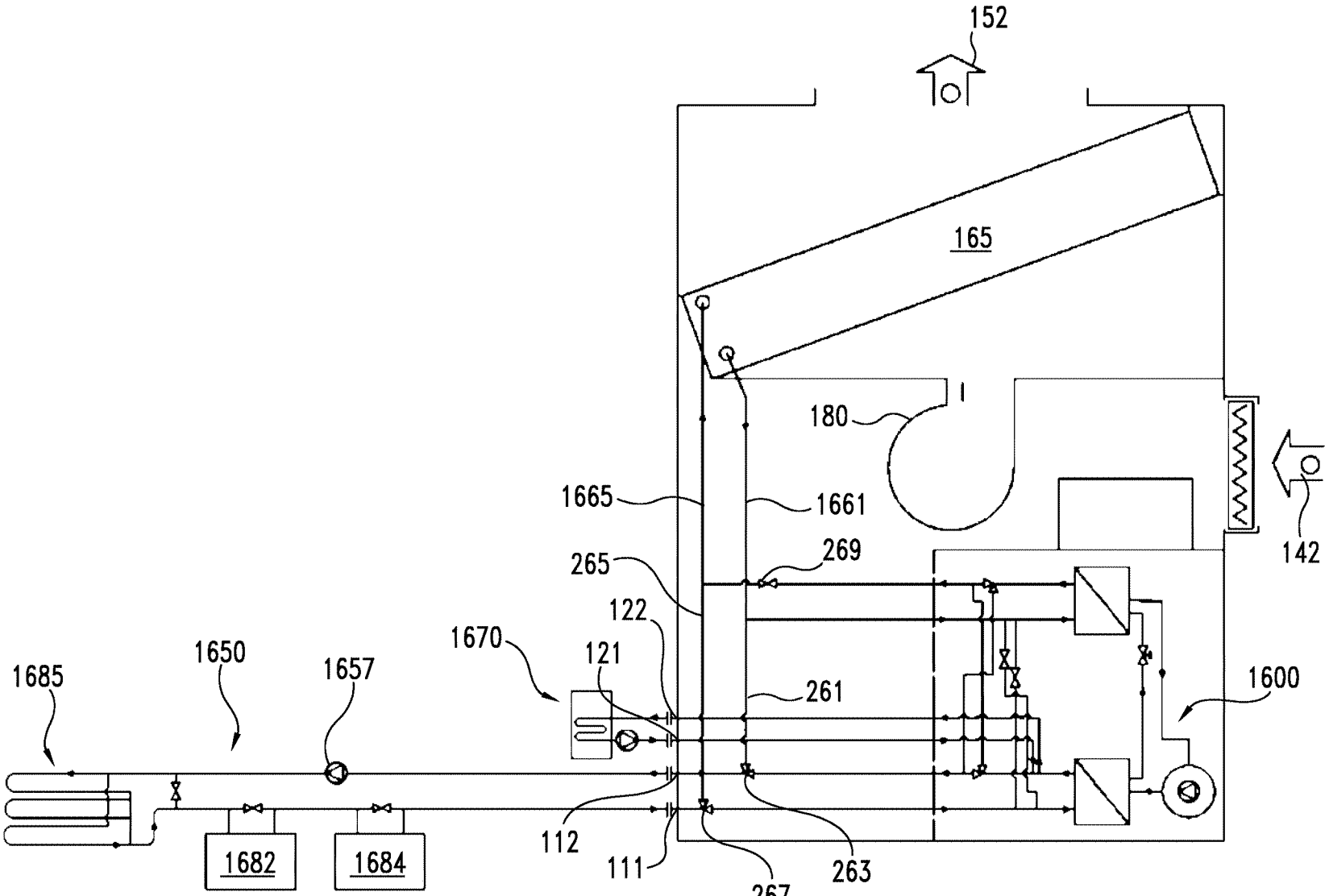
FIG. 6 is a schematic view of the liquid to air switching flow system of FIG. 5 including a source loop that has a geothermal loop and cooling and heating elements.

As illustrated in FIG. 6, the switching flow system 200 may include a source loop 1650 that includes heating elements, such as one or more hydronic solar thermal panels 1682 or a geothermal path 1685, that provide heat to the liquid flowing through the source loop 1650. In some embodiments, this heated fluid may be directed to the switching flow source system 1600 by the free supply diverting valve 267 to provide heat absorption to the refrigeration cycle. However, in other embodiments, the free supply diverting valve 267 may direct the heated fluid from the source loop 1650 directly to the heating/cooling coil 165 through the coil inlet 171. The return air 142 that is blown by the fan 180 across the heating/cooling coil 165 is heated by the heated fluid in the heating/cooling coil 165 and then expelled through the supply air outlet 150 as heated air to heat the exterior space.

The free heating fluid runs through heating/cooling coil 165 and exits heating/cooling coil 165 through coil outlet 173 and into the production return line 1661 and then the direct free return line 261. The free heating fluid is then returned to the source loop 1650 by the free return diverting valve 263 to be reheated. This process provides a source of free heating without having to involve the refrigeration loop of the switching flow source system 1600 when the source loop 1650 provides sufficient heat.

In addition to free heating, the switching flow system 200 may also provide free cooling. The source loop 1650 may include one or more adiabatic or dry coolers 1684 or may provide geothermal cooling from the geothermal path 1685 to cool the liquid flowing through the source loop 1650. In some embodiments, this cooled fluid may be directed to the switching flow source system 1600 by the free supply diverting valve 267 to provide heat rejection to the refrigeration cycle. However, in other embodiments, the free supply diverting valve 267 may direct the cooled fluid from the source loop 1650 directly to the heating/cooling coil 165 through the coil inlet 171. The return air 142 that is blown by the fan 180 across the heating/cooling coil 165 is cooled by the cooling fluid in the heating/cooling coil 165 and then expelled through the supply air outlet 150 as cooled air to cool the exterior space.

The free cooling fluid runs through heating/cooling coil 165 and exits heating/cooling coil 165 through coil outlet 173 and into the production return line 1661 and then the direct free return line 261. The free cooling fluid is then returned to the source loop 1650 by the free return diverting valve 263 to be recooled. This process provides a source of free cooling without having to involve the refrigeration loop of the switching flow source system 1600 when the source loop 1650 provides sufficient cooling.

In some embodiments, the system may be controlled so that the free supply diverting valve 267 diverts the source fluid directly to the coil inlet 171 when the fluid temperature of the source fluid is 110° F. or greater for free heating. Additionally, the system may be controlled so that the free supply diverting valve 267 diverts the source fluid directly to the coil inlet 171 when the fluid temperature of the source fluid is 65° F. or less for free cooling.

In some embodiments, the switching flow source system 1600 may be sized to match the capacity of the fan 180 and the heating/cooling coil 165. In some embodiments, the packaged switching flow system 100, 200 may be sized at 2 to 5 tons to provide heating and/or cooling for a residential unit. In other embodiments, the packaged switching flow system 100, 200 may be sized from 7.5 tons to 20 tons or larger to provide heating and/or cooling for a commercial space.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A switching flow system comprising:

a switching flow system housing;

a heating/cooling coil including a coil inlet and a coil outlet, wherein said heating/cooling coil is positioned within said switching flow system housing;

a fan positioned within said switching flow system housing, wherein said fan is configured to blow air across said heating/cooling coil;

a switching flow apparatus positioned within said switching flow system housing, wherein said switching flow apparatus includes a refrigeration loop including a compressor, first heat exchanger, an expansion valve, and a second heat exchanger, and wherein said switching flow apparatus comprises at least one valve that is controllable to direct fluid from said coil outlet to either said first heat exchanger or to said second heat exchanger;

wherein in a cooling mode, said coil inlet is in fluid communication with said second heat exchanger; and wherein in a heating mode, said coil inlet that was in fluid communication with said second heat exchanger in said cooling mode is switched to be in fluid communication with said first heat exchanger.

2. The switching flow system of claim 1, wherein in the cooling mode, said coil outlet is in fluid communication with said second heat exchanger; and wherein in the heating mode, said coil outlet is in fluid communication with said first heat exchanger.

3. A switching flow system comprising:

a switching flow system housing;

a heating/cooling coil including a coil inlet and a coil outlet, wherein said heating/cooling coil is positioned within said switching flow system housing;

a fan positioned within said switching flow system housing, wherein said fan is configured to blow air across said heating/cooling coil;

a switching flow apparatus positioned within said switching flow system housing, said switching flow apparatus comprising:

a refrigeration loop, wherein said refrigeration loop includes a compressor, a first heat exchanger, an expansion valve, and a second heat exchanger;

a source return inlet and a source supply outlet;

a production return inlet and a production supply outlet;

one or more valves in fluid communication with one or more of said source return inlet, said source supply outlet, said production return inlet, and said production supply outlet;

wherein said one or more valves are controllable to direct fluid from said source return inlet to either said first heat exchanger or to said second heat exchanger and direct fluid from said production return inlet to the other of said first heat exchanger and said second heat exchanger;

a source loop including a source return line in fluid communication with said source return inlet and including a source supply line in fluid communication with said source supply outlet;

a production loop including a production supply line in fluid communication with said production supply outlet and said coil inlet, and a production return line in fluid communication with said production return inlet and in fluid communication with said coil outlet;

wherein in a cooling mode, said one or more valves are arranged so that said source loop is in fluid communication with said first heat exchanger and said production loop is in fluid communication with said second heat exchanger; and wherein in a heating mode, said one or more valves are arranged so that said source loop is in fluid communication with said second heat exchanger and said production loop is in fluid communication with said first heat exchanger.

4. The switching flow system of claim 3, wherein said first heat exchanger heats a source fluid in said source loop when the switching flow system is in the cooling mode; and wherein said first heat exchanger heats a production fluid in said production loop when the switching flow system is in the heating mode.

5. The switching flow system of claim 4, wherein said coil inlet is in fluid communication with said first heat exchanger when the switching flow system is in the heating mode; and wherein said coil outlet is in fluid communication with said first heat exchanger when the switching flow system is in the heating mode.

6. The switching flow system of claim 4, wherein said first heat exchanger is a condenser.

7. The switching flow system of claim 3, wherein said second heat exchanger cools a production fluid in said production loop when the switching flow system is in the cooling mode; and wherein said second heat exchanger cools a source fluid in said source loop when the switching flow system is in the heating mode.

8. The switching flow system of claim 7, wherein said coil inlet is in fluid communication with said second heat exchanger when the switching flow system is in the cooling mode; and wherein said coil outlet is in fluid communication with said second heat exchanger when the switching flow system is in the cooling mode.

9. The switching flow system of claim 7, wherein said second heat exchanger is an evaporator.

10. The switching flow system of claim 3, wherein said switching flow system housing includes a return air inlet, and wherein said return air inlet allows return air from an environment exterior to said switching flow system housing to enter said switching flow system housing.

11. The switching flow system of claim 10, further comprising:

an air filter positioned within said return air inlet.

12. The switching flow system of claim 3, wherein said switching flow system housing includes a supply air outlet that allows air to be expelled from said switching flow system housing.

13. The switching flow system of claim 3, further comprising:

a first heat exchanger control valve in fluid communication with a first heat exchanger outlet;

wherein said first heat exchanger control valve is configured to direct fluid from the first heat exchanger outlet to the source supply line in the cooling mode; and wherein said first heat exchanger control valve is configured to direct fluid from the first heat exchanger outlet to the coil inlet through the production supply line in the heating mode.

14. The switching flow system of claim 13, further comprising:

a second heat exchanger control valve in fluid communication with a second heat exchanger outlet;

wherein said second heat exchanger control valve is configured to direct fluid from the second heat exchanger outlet to the coil inlet through the production supply line in the cooling mode; and wherein said second heat exchanger control valve is configured to direct fluid from the second heat exchanger outlet to the source supply line in the heating mode.

15. The switching flow system of claim 3, further comprising:

a first heat exchanger on/off valve in fluid communication with a first heat exchanger inlet;

wherein said first heat exchanger on/off valve is configured to be closed in the cooling mode so that the first heat exchanger inlet is in fluid communication with the source return line; and wherein said first heat exchanger on/off valve is configured to be open in the heating mode so that the first heat exchanger inlet is in fluid communication with the coil outlet through the production return line.

16. The switching flow system of claim 15, further comprising:

a second heat exchanger on/off valve in fluid communication with a second heat exchanger inlet;

wherein said second heat exchanger on/off valve is configured to be closed in the cooling mode so that the second heat exchanger inlet is in fluid communication with the coil outlet through the production return line; and wherein said second heat exchanger on/off valve is configured to be open in the heating mode so that the second heat exchanger inlet is in fluid communication with the source return line.

17. The switching flow system of claim 3, further comprising:

a domestic hot water supply line in fluid communication with a first heat exchanger outlet of said first heat exchanger, and wherein said domestic hot water supply line is configured to divert fluid from said first heat exchanger outlet to a hot water tank.

18. The switching flow system of claim 3, further comprising:

a free supply diverting valve, wherein said free supply diverting valve is in fluid communication with said source return line, and wherein said free supply diverting valve is controllable to divert fluid from said source return line directly to said coil inlet; and a free return diverting valve, wherein said free return diverting valve is in fluid communication with said source supply line, and wherein said free return diverting valve is controllable to divert fluid from said coil outlet directly to said source supply line.

19. The switching flow system of claim 3, wherein said production loop is a hydronic loop.

* * * * *